US006207258B1

(12) United States Patent
Varnell

(10) Patent No.: US 6,207,258 B1
(45) Date of Patent: Mar. 27, 2001

(54) COMPOSITION AND METHOD FOR IMPROVED INK JET PRINTING PERFORMANCE

(75) Inventor: Daniel F. Varnell, Wilmington, DE (US)

(73) Assignee: Hercules Incorporated, Wilmington, DE (US)

( * ) Notice: Subject to any disclaimer, the term of this patent is extended or adjusted under 35 U.S.C. 154(b) by 0 days.

(21) Appl. No.: 09/126,643

(22) Filed: Jul. 31, 1998

Related U.S. Application Data

(60) Provisional application No. 60/054,320, filed on Jul. 31, 1997.

(51) Int. Cl.[7] ..... B41M 5/00

(52) U.S. Cl. ..... 428/195; 428/211; 428/341; 428/342

(58) Field of Search ..... 428/195, 211, 428/341, 342, 411.1

(56) References Cited

U.S. PATENT DOCUMENTS

| | | | |
|---|---|---|---|
| 2,873,203 | 2/1959 | Hopkins et al. | 106/238 |
| 3,116,147 | 12/1963 | Uber et al. | 96/1 |
| 3,615,403 | 10/1971 | Cheng | 96/1.5 |
| 3,884,685 | 5/1975 | Green, Jr. et al. | 96/1.4 |
| 4,020,210 | 4/1977 | Geer | 428/307 |
| 4,110,155 | 8/1978 | Minagawa et al. | 162/135 |
| 4,310,360 | 1/1982 | Kvant | 106/306 |
| 4,861,376 | 8/1989 | Edwards et al. | 106/123.1 |
| 5,126,010 | 6/1992 | Kobayashi et al. | 162/135 |
| 5,170,807 | 12/1992 | Kasbo et al. | 131/365 |
| 5,182,175 | 1/1993 | Sakaki et al. | 428/537.5 |
| 5,266,383 | 11/1993 | Sakaki et al. | 428/195 |
| 5,338,597 | 8/1994 | Kurabayashi et al. | 428/195 |
| 5,472,485 | 12/1995 | Pandian et al. | 106/194 |
| 5,474,843 | 12/1995 | Lambert et al. | 428/327 |
| 5,522,968 | 6/1996 | Kuroyama et al. | 162/188.1 |
| 5,620,793 | 4/1997 | Suzuki et al. | 428/342 |
| 5,640,187 | 6/1997 | Kashiwazaki et al. | 347/101 |

FOREIGN PATENT DOCUMENTS

| | | |
|---|---|---|
| 0 620 315 A1 | 10/1994 | (EP) . |
| 0 776 767 A1 | 6/1997 | (EP) . |
| 0 829 374 A2 | 3/1998 | (EP) . |
| 57-102391 | 6/1982 | (JP) . |
| 61-034553 | 2/1986 | (JP) . |
| 62-156985 | 7/1987 | (JP) . |
| 1-126647 | 5/1989 | (JP) . |
| 2-243382 | 9/1990 | (JP) . |
| 3-234886 | 10/1991 | (JP) . |
| 4-146295 | 5/1992 | (JP) . |
| 5-171599 | 7/1993 | (JP) . |
| 5-239792 | 9/1993 | (JP) . |
| 5-239793 | 9/1993 | (JP) . |
| 6-051429 | 2/1994 | (JP) . |
| 6-99655 | 4/1994 | (JP) . |
| 6-0143799 | 5/1994 | (JP) . |
| 6-202371 | 7/1994 | (JP) . |
| 9-143895 | 6/1997 | (JP) . |
| WO 96/35841 | 11/1996 | (WO) . |
| WO 97/30218 | 8/1997 | (WO) . |

*Primary Examiner*—Bruce H. Hess
(74) *Attorney, Agent, or Firm*—Akin, Gump, Strauss, Hauer & Feld, L.L.P.

(57) ABSTRACT

This invention relates to a composition useful for surface treating a sheet substrate for ink jet printing, the composition comprising a salt of a divalent metal, the salt being soluble in an aqueous sizing medium at about pH 7 to about pH 9, the aqueous sizing medium further comprising a carrier agent and a sizing agent. It also includes a method of making an ink jet printing substrate capable of retaining indicia formed by ink jet printing using pigmented ink, the method comprising surface treating the substrate with an aqueous sizing medium containing a divalent metal salt. A method for improving print quality of ink jet printing of pigmented ink on a surface treated substrate made using the composition or method is also disclosed, as is the paper so made, with and without ink jet printed pigmented ink applied thereto. Indicia printed thereon will have improved print quality characteristics.

54 Claims, No Drawings

COMPOSITION AND METHOD FOR IMPROVED INK JET PRINTING PERFORMANCE

CROSS-REFERENCE TO RELATED APPLICATION

This application claims the benefit of U.S. Provisional Patent Application No. 60/054,320, filed Jul. 31, 1997.

BACKGROUND OF THE INVENTION

The present invention relates to compositions for surface treatments for substrates, such as paper and polymeric plastic material used for ink jet printing, as well as methods for making the printing substrates, the treated printing substrate itself, methods of enhancing ink jet printing, and ink jet printed printing substrates.

In today's commercial, business, office and home environments, paper is commonly used for multiple purposes, such as reprographic copying, laser printing, ink jet printing, and the like. Specialty papers have been developed for each type of application, but as a practical matter, a multipurpose paper suitable for all such uses is desirable. Of the above-indcated uses, perhaps ink jet printing has the most demanding requirements, since the ink is printed wet and must provide good print quality and dry quickly, properties which are often difficult to achieve together.

Much of the paper intended for ink jet printing is coated with various types of special coatings, typically a layer of water soluble polymer and silica and other insoluble fillers, that makes the paper very expensive, especially in consideration of the desire and tendency to use the paper for other general office purposes, such as copying and laser printing. A typical cost per page of such paper is about $0.10. By comparison, uncoated paper, such as copy paper, generally sells for less than $0.01 per page.

Ink jet printing has been practiced commercially only in recent years. Desk top ink jet printing is an even more recent development. Most ink jet printing inks, both black ink and colored inks, are dye-based inks. Use of black pigmented inks in desk top ink jet printing is relatively new, dating from the introduction of Hewlett Packard's DeskJet® 660C printer in 1994. Desk top ink jet printing with pigmented inks other than black, e.g., pigment-based colored inks, has yet to become commercially available, but is expected to become comercially available in the near future.

Paper is made with and/or surface treated with sizing agents primarily to prevent excess penetration, wicking or spread of water or ink. Many different types of nonreactive and reactive sizing agents are well known in the papermaking industry. Paper typically made under acidic paper making conditions, referred to as acid paper, is ususally sized with well-known rosin-derived sizing agents (referred to herein as "dispersed rosin sizing agents"), a nonreactive sizing agent. Some papers made under neutral and alkaline paper making conditions may also be sized with dispersed rosin sizing agents. The most common sizing agents for fine paper made under alkaline conditions, referred to as alkaline paper, are alkenyl succinic anhydride (ASA) and alkyl ketene dimer (AKD). Another class of sizing agents useful for sizing fine paper includes ketene dimers and multimers that are liquid at room temperature, such as alkenyl ketene dimers and multimers. These are reactive sizing agents, since they have a reactive functional group that covalently bonds to cellulose fiber in the paper and hydrophobic tails that are oriented away from the fiber. The nature and orientation of these hydrophobic tails cause the fiber to repel water.

The growing popularity of ink jet printers has also focused attention on the sizing requirements for paper intended for this end use application.

The following ink jet print characteristics relating to print quality have been identified by manufacturers of ink jet printers as being important to high quality ink jet printing, many of which are affected by the type and treatment of paper or other substrate to which the ink is applied.

OPTICAL DENSITY: Color intensity as measured by the change in reflectance ($OD=\log_{10}(I_i/I_r)$ where $I_i$ and $I_r$=Incident and reflected light intensities, respectively), where high optical density is desired.

SHOW THROUGH: Color intensity of an image that is observed from the back side of the sheet, which can be measured by optical density.

SPECKLED SHOW THROUGH: Often on the back side of a printed image there is a speckled appearance as ink finds its way through pinholes or areas of poor formation.

LINE GROWTH (BLEED) (FEATHERING): The final printed size features versus the initial printed size, which can be seen as lost resolution. It occurs in both single color printing and when colors are printed next to and on top of each other.

EDGE ROUGHNESS (SOMETIMES CALLED FEATHERING): A rough versus smooth appearance of edges as ink spreads unevenly away from the printed area. It occurs in both single color printing and when colors are printed next to or on top of each other.

WICKING: Observed as long spikes of ink extending from printed areas such as when ink runs along a single fiber at the surface of the paper.

MOTTLE: Unevenness of the print optical density in a solid printed area.

BRONZING: An appearance in black printed areas of a bronze sheen (reddish tint).

COLOR INDEX: The hue or shade of the printed colors or combined colors. In addition, with a composite black print (made with cyan, magenta, and yellow), there is often a greenish tint.

DRY TIME: The time it takes for the ink to dry such that it will not smear or transfer to other surfaces.

CASCADING: Lines of low print density that occur between passes of the print head, which is usually observed on some very highly sized papers.

INSUFFICIENT DOT GAIN: Similar to cascading but shows up as a white area visible around dots of ink in a solid print area because they have not spread enough. The effect is to lower optical density.

MISTING: Very small spots visible around the edges of printed areas that come from where very small drops (mist) of ink have sprayed out from the main print droplet.

It has been known to coat paper used as photocopy paper with materials that increase its conductivity, e.g., treating the paper so that the paper has a hygroscopic inorganic salt throughout its body structure as disclosed by Uber et al. in U.S. Pat. No. 3,116,147; by coating with inorganic salt-resin coatings as described by Cheng in U.S. Pat. No. 3,615,403; by surface treating with a binder like starch and a sulfate salt as described by Green, Jr. et al. in U.S. Pat. No. 3,884,685; or by surface treating with microencapsulated salts as described by Geer in U.S. Pat. No. 4,020,210.

Calcium carbonate is often added to paper as a dispersed filler. Calcium carbonate has the disadvantage of being a relatively insoluble particulate solid that requires dispersing in aqueous systems. The presence of fillers such as calcium carbonate can lead to increased wear of equipment parts during paper manufacture and end-use applications.

Calcium chloride in high concentrations with a reactive sizing agent have been added to paper, as a first of two coatings, the second of which includes calcium carbonate, potassium silicate and carboxymethylcellulose, to control burn characteristics such as in cigarettes, as disclosed by Kasbo et al. in U.S. Pat. No. 5,170,807, but such paper is not suitable for ink jet printing, and such high concentrations of calcium chloride are not suitable for preparing a paper used for printing.

Aluminum sulfate (alum) is a common additive to many paper machines, generally being added at the wet end of a paper machine. Alum is added to rosin sizing dispersions, used as internal sizes in paper making, and the alum level in the rosin sizing dispersion may be as high as 66% of the solids. Alum is dissolved at a low pH to give cationic aluminum species. Alum will form non-cationic species at a typical size press pH of 8.

Calcium chloride has been added to paper for milk carton applications. Such paper has a high basis weight about 3 to 5 times greater than normal copy paper and is coated with wax.

Sizing compositions particularly for sizing paper used in products with superior alkali metal or aluminum liquid storage properties include a metal salt selected from zirconium, hafnium, titanium and mixtures thereof, as described in Pandian et al. U.S. Pat. No. 5,472,485.

Sizing dispersions containing storage stabilizing amounts of water-soluble alkali metal or aluminum inorganic salts are described in International Patent Publication WO 96/35841 of Eka Chemicals AB, useful as internal sizes or surface sizes for paper, board and cardboard.

Paper has been treated with relatively high concentrations 0.5–5% of deliquescent salt such that the paper, used as a base material for a resin-coated laminate, does not have wavy deformations at the edges when the paper is coated on both surfaces with synthetic resin films, as described by Minagawa et al. in U.S. Pat. No. 4,110,155.

Paper suitable for ink jet printing with dye-based inks is described by Kuroyama et al. in U.S. Pat. No. 5,522,968, Suzuki et al. in U.S. Pat. No. 5,620,793 and Sakaki et al. in U.S. Pat. Nos. 5,266,383 and 5,182,175.

A method and equipment for ink jet printing with pigmented ink is described by Kashiwazaki et al. in U.S. Pat. No. 5,640,187. As is evident from the disclosures of Kashiwazaki et al., a need exists for quality ink jet printing performance without resorting to the use of specialty coated paper.

The disclosures of all of the patents, published applications and other publications identified herein are hereby incorporated herein by reference.

SUMMARY OF THE INVENTION

One aspect of this invention relates to a composition useful for surface treating a substrate for ink jet printing, the composition comprising a salt of a divalent metal, the salt being soluble in an aqueous sizing medium at about pH 7 to about pH 9, the aqueous sizing medium further comprising a carrier agent and a sizing agent.

Another aspect of this invention relates to a composition useful for surface treating a substrate for ink jet printing with pigmented ink, the composition comprising a carrier agent, a sizing agent and a salt selected from the group consisting of calcium chloride, magnesium chloride, calcium bromide, magnesium bromide, calcium nitrate, magnesium nitrate, calcium acetate and magnesium acetate.

Still another aspect of this invention relates to a method of making an ink jet printing substrate capable of retaining indicia formed by ink jet printing using pigmented ink, the method comprising (a) surface treating the substrate with a composition comprising a salt of a divalent metal, the salt being soluble in an aqueous sizing medium at about pH 7 to about pH 9, the aqueous sizing medium further comprising a sizing agent; and (b) drying the treated substrate.

Yet another aspect of the present invention relates to a method for improving print quality of indicia formed by ink jet printing of pigmented ink on a surface treated substrate comprising surface treating the substrate using the divalent metal salt composition or by using the method of this invention, drying the treated substrate, and printing the pigmented ink onto the dried treated substrate by ink jet printing to form the indicia.

Still another aspect of the invention is a printing substrate made using the divalent metal salt composition or by using the method of this invention, the printing substrate being capable of carrying indicia formed from pigmented ink on the dried treated substrate, such that the indicia will have at least one improved ink jet printing characteristic compared to a printing substrate treated using the same composition or method like those of this invention but without the salt.

DETAILED DESCRIPTION OF THE INVENTION

It has unexpectedly been discovered that ink jet print quality on a surface sized paper or other surface treated substrate can be enhanced if the substrate surface is treated with an aqueous sizing medium containing a divalent metal salt that is soluble therein at about pH 7 to about pH 9. The divalent metal salt is premixed with the aqueous sizing medium, which contains a sizing agent, and preferably a carrier agent, to form a composition according to the present invention.

The divalent metal salts used in this invention provide unexpected and surprising improvements in ink jet printing of paper so treated of at least one, and preferably several of the ink jet printing quality characteristics, and particularly improved optical density, reduced show-through of the ink to the back side of the paper, and improved print quality with reduced edge roughness and line growth. The benefits are evidenced with the use of pigmented inks used in ink jet printing. The benefits of this invention have been demonstrated with printing samples using a Hewlett Packard 660C DeskJet printer ("HP660C" printer) which uses a pigmented black ink. The same benefits have not been observed with a Hewlett Packard 560C DeskJet printer nor with an Epson 720 Stylus printer, both of which use dye-based black ink, rather than pigmented black ink. The benefits have not been observed with the dye-based color inks, as compared with pigmented black ink, that were used with the HP660C printer. As used herein, the term "pigmented ink" means an ink in which a black or color component is insoluble in the ink formulation, and the term "dye-based ink" means an ink in which the black or color component is soluble in the ink formulation.

The ink for which the present invention is particularly effective is an ink that contains an anionically charged pigment and which does not contain a nitrogen based dye or a dissolution aid for such a dye that is a nitrogen compound that releases ammonia or ammonium ion during or as a result of printing on the substrate, such that the substrate should contain a material for absorbing the ammonia or ammonium ion.

Reports in the literature confirm that the ink-jet industry is moving more toward the use of pigmented ink; see *American Ink Maker*, 75(6):60 (June 1997). The trend in the industry toward pigment-based ink jet inks includes color inks, although pigmented color inks have not yet been commercialized for desktop printing applications. The general consensus in the printing industry is that pigment-based inks provide better permanence and better performance for printed material exposed to an outdoor environment, such as printed advertising or notices on billboards and other signage, bus stops, outdoor benches, and other outdoor uses. This invention is extremely beneficial because it provides greatly enhanced ink jet print performance on uncoated paper and thus avoids the need to use costly specialty papers for quality ink jet print performance.

Currently, providing paper with superior ink jet print performance requires that the paper be coated with a layer of water soluble polymer and silica and other insoluble fillers. A typical cost per page of such paper is about $0.10. By comparison, uncoated paper such as copy paper generally sells for less than $0.01 per page. Such uncoated paper is normally sized internally or treated on the paper machine at a size press, with a typical sizing agent, along with the usual additives, including emulsifiers, retention aids, optical brightening agents and other additives.

The present invention includes a composition containing, in addition to water, the soluble divalent metal salt of this invention, a sizing agent and preferably, a carrier agent, where the components do not result in precipitation or coagulation; and a method of surface treating paper or other substrate with an aqueous sizing medium containing a water soluble divalent metal salt. The invention also includes improved ink jet printable and printed paper and other substrates, as well as an improved ink jet printing method. The invention is also useful for enhancing ink jet printing on transparency films and non-cellulosic sheet substrates.

The metal salt used in this invention is a divalent metal salt soluble in the amount used in an aqueous sizing medium, at about pH 7 to about pH 9. The aqueous sizing medium may be in the form of an aqueous solution, emulsion, dispersion, or a latex or colloidal composition, and the term "emulsion" is used herein, as is customary in the art, to mean either a dispersion of the liquid-in-liquid type or of the solid-in-liquid type, as well as latex or colloidal composition. The metal salt of this invention is preferably a mineral or organic acid salt of a divalent cationic metal ion. The salt must be water soluble at a pH of about pH 7 to about pH 9, which includes the pH of an aqueous sizing medium generally used in a size press. The relative weight of the divalent cationic metal ion in the metal salt is preferably maximized with respect to the anion in the salt selected, to provide enhanced efficiencies based on the total weight of applied salt. Consequently, for this reason, for example, calcium chloride is preferred over calcium bromide.

The water soluble metal salt may include a halide of calcium, magnesium, barium or the like, with calcium chloride and magnesium chloride being particularly preferred. Divalent metal salts that are effective in this invention are, without limitation, calcium chloride, magnesium chloride, magnesium bromide, calcium bromide, barium chloride, calcium nitrate, magnesium nitrate, barium nitrate, calcium acetate, magnesium acetate and barium acetate. Calcium chloride and magnesium chloride are preferred, since they provide the greatest improvement in ink jet printing performance and they work efficiently on a cost-benefit basis.

In the present invention, monovalent metal salts, such as sodium chloride and potassium chloride are not nearly as effective as the divalent metal salts to enhance the print quality of ink jet pigmented inks. The reason is not entirely understood, but it is believed that it may be due to an ineffective charge density.

The divalent metal salt may be mixed with conventional papermaking sizing agents, including nonreactive sizing agents and reactive sizing agents, as well as combinations or mixtures of sizing agents.

Many nonreactive sizing agents are known in the art. Examples include, without limitation, BASOPLAST® 335D nonreactive polymeric surface size emulsion from BASF Corporation (Mt. Olive, N.J.), FLEXBOND® 325 emulsion of a copolymer of vinyl acetate and butyl acrylate from Air Products and Chemicals, Inc. (Trexlertown, Pa.), and PENTAPRINT® nonreactive sizing agents (disclosed for example in Published International Patent Application Publication No. WO 97/45590, published Dec. 4, 1997, corresponding to U.S. patent application Ser. No. 08/861,925, filed May 22, 1997) from Hercules Incorporated (Wilmington, Del.), to name a few.

For papermaking carried out under alkaline pH manufacturing conditions, sizing agents based on alkyl ketene dimers (AKDs) or alkenyl ketene dimers or multimers and alkenyl succinic anhydride (ASA) sizing agents are preferred. Combinations of these and other paper sizing agents may also be employed.

Ketene dimers used as paper sizing agents are well known. AKDs, containing one β-lactone ring, are typically prepared by the dimerization of alkyl ketenes made from two fatty acid chlorides. Commercial alkyl ketene dimer sizing agents are often prepared from palmitic and/or stearic fatty acids, e.g. Hercon® and Aquapel® sizing agents (both from Hercules Incorporated).

Alkenyl ketene dimer sizing agents are also commercially available, e.g. Precis® sizing agents (Hercules Incorporated).

U.S. Pat. No. 4,017,431, provides a nonlimiting exemplary disclosure of AKD sizing agents with wax blends and water soluble cationic resins.

Ketene multimers containing more than one β-lactone ring, may also be employed as paper sizing agents.

Sizing agents prepared from a mixture of mono- and dicarboxylic acids, have been disclosed as sizing agents for paper in Japanese Kokai Nos. 168991/89 and 168992/89.

European patent application Publication No. 0 629 741 A1 discloses alkyl ketene dimer and multimer mixtures as sizing agents in paper used in high speed converting and reprographic machines. The alkyl ketene multimers are made from the reaction of a molar excess of monocarboxylic acid, typically a fatty acid, with a dicarboxylic acid. These multimer compounds are solids at 25° C.

European patent application Publication No. 0 666 368 A2 and Bottorff et al. in U.S. Pat. No. 5,685,815, disclose paper for high speed or reprographic operations that is internally sized with an alkyl or alkenyl ketene dimer and/or multimer sizing agent. The preferred 2-oxetanone multimers are prepared with fatty acid to diacid ratios ranging from 1:1 to 3.5:1.

Commercial ASA-based sizing agents are dispersions or emulsions of materials that may be prepared by the reaction of maleic anhydride with an olefin ($C_{14}$–$C_{18}$).

Hydrophobic acid anhydrides useful as sizing agents for paper include:

(i) rosin anhydride (see U.S. Pat. No. 3,582,464, for example);

(ii) anhydrides having the structure (I):

(I)

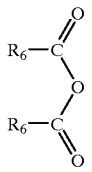

where each $R_6$ is the same or a different hydrocarbon radical; and (iii) cyclic dicarboxylic acid anhydrides, preferably having the structure (II):

(II)

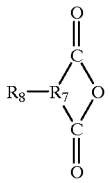

where $R_7$ represents a dimethylene or trimethylene radical and where $R_8$ is a hydrocarbon radical.

Specific examples of anhydrides of formula (I) are myristoyl anhydride; palmitoyl anhydride; olcoyl anhydride; and stearoyl anhydride.

Preferred substituted cyclic dicarboxylic acid anhydrides falling within the above formula (II) are substituted succinic and glutaric anhydrides. Specific examples of anhydrides of formula (II) are i- and n-octadecenyl succinic acid anhydride; i- and n-hexadecenyl succinic acid anhydride; i- and n-tetradecenyl succinic acid anhydride, dodecyl succinic acid anhydride; decenyl succinic acid anhydride; ectenyl succinic acid anhydride; and heptyl glutaric acid anhydride.

Nonreactive sizing agents useful in the present invention include a polymer emulsion including a cationic polymer emulsion, an amphoteric polymer emulsion and mixtures thereof. Preferred polymer emulsions are those wherein the polymer of the polymer emulsion is made using at least one monomer selected from the group consisting of styrene, α-methylstyrene, acrylate having an ester substituent with 1 to 13 carbon atoms, methacrylate having an ester substituent with 1 to 13 carbon atoms, acrylonitrile, methacrylonitrile, vinyl acetate, ethylene and butadiene; and optionally comprising acrylic acid, methacrylic acid, maleic anhydride, esters of maleic anhydride or mixtures thereof, with an acid number less than about 80. Of these, more preferred are those where the polymer is made using at least one monomer selected from the group consisting of styrene, acrylate having an ester substituent with 1 to 13 carbon atoms, methacrylate having an ester substituent with 1 to 13 carbon atoms, acrylonitrile and methacrylonitrile. The polymer emulsion preferably is stabilized by a stabilizer predominantly comprising degraded starch, such as that disclosed, for example, in U.S. Pat. Nos. 4,835,212, 4,855,343 and 5,358,998. Also preferably, the polymer emulsion has a glass transition temperature of about −15° C. to about 50° C.

For traditional acid pH papermaking conditions, nonreactive sizing agents in the form of dispersed rosin sizing agents are typically used. Dispersed rosin sizing agents are well known by those skilled in the paper making industry. Nonlimiting examples of rosin sizing agents are disclosed in many patents, among them Aldrich U.S. Pat. Nos. 3,966,654 and 4,263,182.

The rosin useful for the dispersed rosin sizing agents used in the present invention can be any modified or unmodified, dispersible or emulsifiable rosin suitable for sizing paper, including unfortified rosin, fortified rosin and extended rosin, as well as rosin esters, and mixtures and blends thereof. As used herein, the term "rosin" means any of these forms of dispersed rosin useful in a sizing agent.

The rosin in dispersed form can be any of the commercially available types of rosin, such as wood rosin, gum rosin, tall oil rosin, and mixtures of any two or more, in their crude or refined state. Tall oil rosin and gum rosin are preferred. Partially hydrogenated rosins and polymerized rosins, as well as rosins that have been treated to inhibit crystallization, such as by heat treatment or reaction with formaldehyde, also can be employed.

A fortified rosin useful in this invention is the adduct reaction product of rosin and an acidic compound containing the

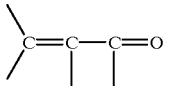

group and is derived by reacting rosin and the acidic compound at elevated temperatures of from about 150° C. to about 210° C.

The amount of acidic compound employed will be that amount which will provide fortified rosin containing from about 1% to about 16% by weight of adducted acidic compound based on the weight of the fortified rosin. Methods of preparing fortified rosin are well known to those skilled in the art. See, for example, the methods disclosed and described in U.S. Pat. Nos. 2,628,918 and 2,684,300.

Examples of acidic compounds containing the

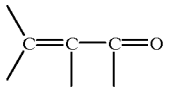

group that can be used to prepare the fortified rosin include the alpha-beta-unsaturated organic acids and their available anhydrides, specific examples of which include fumaric acid, maleic acid, acrylic acid, maleic anhydride, itaconic acid, itaconic anhydride, citraconic acid and citraconic anhydride. Mixtures of acids can be used to prepare the fortified rosin if desired. Thus, for example, a mixture of the acrylic acid adduct of rosin and the fumaric acid adduct can be used to prepare the dispersed rosin sizing agents of this invention. Also, fortified rosin that has been substantially completely hydrogenated after adduct formation can be used.

Various rosin esters of a type well known to those skilled in the art can also be used in the dispersed rosin sizing agents of the present invention. Suitable exemplary rosin esters may be rosin esterified as disclosed in U.S. Pat. Nos. 4,540,635 (Ronge et al.) or U.S. Pat. No. 5,201,944 (Nakata et al.).

The unfortified or fortified rosin or rosin esters can be extended if desired by known extenders therefor such as waxes (particularly paraffin wax and microcrystalline wax); hydrocarbon resins including those derived from petroleum hydrocarbons and terpenes; and the like. This is accomplished by melt blending or solution blending with the rosin or fortified rosin from about 10% to about 100% by weight, based on the weight of rosin or fortified rosin, of the extender.

Also blends of fortified rosin and unfortified rosin; and blends of fortified rosin, unfortified rosin, rosin esters and rosin extender can be used. Blends of fortified and unfortified rosin may comprise, for example, about 25% to 95% fortified rosin and about 75% to 5% unfortified rosin. Blends of fortified rosin, unfortified rosin, and rosin extender may comprise, for example, about 5% to 45% fortified rosin, 0 to 50% rosin, and about 5% to 90% rosin extender.

Hydrophobic organic isocyanates, e.g., alkylated isocyanates, are another class of compounds used as paper sizing agents that are well known in the art that can be used in this invention.

Other conventional paper sizing agents suitable for use in this invention include alkyl carbamoyl chlorides, alkylated melamines such as stearylated melamines, and styrene acrylates.

Mixtures of reactive and nonreactive sizing agents may be used in the present invention.

The sizing agent composition containing the divalent metal salt of the present invention can give an additive enhancement to the optical density of pigmented ink jet printing over the performance of the salt alone; furthermore, the sizing agent also enhances the print quality of dye-based ink jet inks, by virtue of the sizing agent component of the composition. Thus, the sizing compositions containing the divalent metal salts of the present invention with a sizing agent provide improved quality of ink jet printing using dye-based ink and pigmented ink. There is a balance that must be achieved when using the sizing agent composition containing the metal salt of the present invention. Too much of either component will not be acceptable. Low concentrations of the metal salt are preferred for surface applications within the concentration ranges specified below. Too much salt in excess of the concentrations noted below may adversely affect conductivity and cause corrosion of paper processing equipment. Calcium chloride, being efficient in its performance at relatively low concentrations, is a particularly preferred metal salt. Too much of the sizing agent, in excess of the ranges specified, may cause cascading, may adversely affect converting and feeding, may increase the cost without enhancing the performance benefit and may lead to deposits of materials on the paper making equipment. The suitable level of sizing agent can be determined by those skilled in the art.

The composition of the present invention contains about 0.01% to about 3% of the sizing agent, preferably about 0.05% to about 3%, and more preferably, about 0.1% to about 1%.

All percentages in this disclosure are by weight based on the weight of the solution, mixture, composition, or paper, as appropriate, unless noted otherwise.

The concentration of the divalent metal salt in the sizing composition of this invention is about 0.01% to about 3%, preferably about 0.05% to about 3%, and more preferably, about 0.1% to about 1%.

An important parameter in this invention is the concentration or level of the divalent metal salt in the final dried paper. The amount of metal salt in the size press solution or other coating medium is generally adjusted to provide the desired concentration or weight in the finished dried paper. The amount in the final paper is set by the concentration in the composition and size press solution and the pick-up of (or amount applied to) the substrate. The concentration of the divalent metal salt in the dried paper should be about 0.01% to about 0.4%. The preferred concentration is about 0.02% to about 0.3%, and the most preferred concentration is about 0.05% to about 0.2%, all based on the total weight of the finished dried paper. The level of addition onto the paper typically may be, e.g., approximately 0.15% salt with about 0.02% to about 0.3% sizing agent, and typically about 0.02% to about 0.10% sizing agent.

Because basis weight of the substrate such as paper surface treated with the salt may vary, the concentration of salt on the dried paper or other substrate is preferably measured as a unit weight of dried salt per unit area. The concentration of salt on the substrate, after being surface treated or sized (and dried), should be about 0.01 $g/m^2$ to about 1 $g/m^2$. Preferably, the concentration should be about 0.02 $g/m^2$ to about 0.3 $g/m^2$, and more preferably, about 0.03 $g/m^2$ to about 0.2 $g/m^2$.

The weight ratio of the divalent metal salt, e.g., calcium chloride or magnesium chloride, to the sizing agent(s) and other additives in the aqueous sizing composition of the present invention is about 1:20 to about 20:1. More preferably, the weight ratio is about 1:5 to about 5:1. Most preferably, the ratio is about 1:3 to about 3:1.

The salt-containing sizing composition preferably contains a carrier agent and can also be used with other conventionally used sizing composition additives, such as size press additives, provided there is no resulting precipitation or coagulation of the components of the composition. Constraints on the addition of materials with the salt-contining composition are compatibility and performance. Some materials, such as solutions of anionic polymeric styrene maleic anhydride sizing agents and strongly anionic soluble meaterials, e.g. strongly anionic rosin soap sizing agents, are not compatible with the divalent metal salts of this invention. Those mixtures which lead to coagulation and precipitation of the added material such that the paper maker can no longer make paper are not suitable. Additives that by themselves improve ink jet printing are preferably used in combination with the metal salts of this invention because this invention further enhances their performance.

The sizing compositions containing the divalent metal salts of this invention are suitable for use with a wide variety of additives, preferably including a carrier agent. As used herein, a "carrier agent" includes starch or a binding agent, such as polyvinyl alcohol, polyvinylpyrrolidone or polyethyleneimine, with which the sizing agent and the divalent metal salt and optional additives may be mixed, for application to the substrate. Such combinations with one or more additives may be prepared as a premixture, to be added, e.g., to a size press emulsion, or may be prepared in situ by addition of the individual components to a size press emulsion or other coating medium. The preferred premixture systems are premixed compositions containing calcium halide and/or magnesium halide, particularly calcium chloride, with reactive sizes, such as 2-oxetanone dimers and multimers, with nonreactive sizes or mixtures thereof. The nonreactive sizing agent may be, for example, a dispersed rosin sizing agent or a polymer emulsion including a cationic polymer emulsion, an amphoteric polymer emulsion and mixtures thereof, as disclosed above.

Any compatible optional surface treatment additives may be added to the sizing composition containing the divalent metal salt, provided that precipitation or coagulation does not occur, and such additives include latex emulsions conventionally used as paper additives or for other purposes.

The invention is particularly useful with alkaline paper sheets sized with 2-oxetanone dimers (such as AKDs and alkenyl ketene dimers) and 2-oxetanone multimers (such as alkenyl ketene multimers), acid anhydrides (such as ASA), and with acid paper sheets sized with dispersed rosin sizing agents.

Conventional application of other materials to enhance ink jet printing, such as high levels of fillers bound with a water soluble polymer, or polyvinyl alcohol, can lead to rheological problems if introduced at the size press, but the current invention is not subject to such problems.

The size press emulsion or other aqueous medium containing the metal salt of this invention may also contain other conventionally used paper additives used in treating uncoated paper, such as fillers (silica by way of nonlimiting example), optical brightening agents, defoamers, and biocides. Use of the metal salt of this invention with such additives is desirable in many cases, since the presence of the salt provides enhanced performance of such additives and enhanced ink jet printing performance.

The level of the other optional additives in the sizing composition is generally about 0.01% to about 3%, and varies with the type of additive and the amount of solution picked up by the paper during size press treatment.

The aqueous sizing medium preferably containing a carrier agent, such as an aqueous starch solution, may be made in the conventional way, using the usual components and additives in the conventional amounts, all as is well-known to those skilled in the paper making industry. Where starch is used as the carrier agent, the components of this invention should be added to the cooked starch (and the starch should be used between a pH of 7 and 9) and at temperature of about 50° C. to about 80° C. Holding times, compatibility of additives and other conditions and equipment may be selected in accordance with conventional practices of those skilled in the art.

When other additives are used with the sizing agent and metal salt, all of the components are preferably applied to the paper surface concurrently, e.g., in a single operation, whether the additives are premixed with the sizing agent and salt composition or added concurrently with such composition.

The surface sizing medium containing the metal salt is applied as a surface treatment to the paper in the method of this invention. The sizing compositions of this invention may be applied to the surface of the paper or other substrate by any of several different conventional means, well known in the paper making and coating arts. The sizing composition is normally applied as a surface treatment to both sides of the paper being treated, but if desired, surface application could be made to only one side of the paper sheet.

As used herein, "surface sizing" or equivalent terms (such as "surface sized") means applying the sizing agent at or near the size press or at a position in a paper making system where the sized press would otherwise be present. Typically a size press is located downstream of a first drying section of a papermaking machine.

A preferred surface sizing method of application of the composition to a paper substrate in the form of a sheet or web uses a conventional metered or nonmetered size press in a conventional paper making process. When this technique is used, the application temperature is at a temperature of at least about 50° C. and not greater than about 80° C., typically about 60° C. The invention is not limited to treatment of the paper or other substrate via the size press treatment or at the temperature typically used at the size press, since the substrate may also be surface treated with the composition by other methods.

Other surface application methods and equipment may also be used to apply the composition containing the divalent metal salts to the surface of the paper, coated paper, plastic film or other sheet substrate, with or without other paper additive components, such as by using conventional coating equipment (e.g., with a Mayer rod or doctor bar) or spraying techniques. Surface application may also be made at points other than the size press in the paper making process, e.g., at the calender stack, to obtain a paper having the desired ink jet printing characteristics. All types of conventionally used equipment are suitable.

The application of materials at or after the size press is very different from wet end treatment of paper. The conditions of application and the distribution of materials within the paper will be different. The paper is at least partially dried prior to the size press and it is subsequently dried by conventional methods after the size press or other application point or technique.

As noted above, the composition of this invention preferably may be added at the size press, e.g., with the starch and other additives that are currently used with uncoated paper. A size press solution suitable for use in this invention may be prepared by conventional techniques. Such size press solution generally comprises a starch solution, containing about 2% to about 20% starch, that has been cooked in some fashion and that is kept hot. The temperature of the solution is generally about 60° C. The concentration of starch in the starch solution is preferably about 4% to about 16%, and most preferably about 6% to about 12%.

Where the carrier agent is a binding agent as discussed above, the binding agent is present in the composition such that the composition has a viscosity of no more than about 1000 centipoise (cp), and preferably, no more than about 500 cp. The amount of binding agent used will depend on the molecular characteristics of the particular binding agent chosen, as well as the characteristics of the other components of the composition.

The paper used in the method of this invention is not critical and may be any paper grade that requires sizing in its normal end-use application. The paper may include both cellulosic and polymeric plastic fibers. Preferably, the paper contains predominantly cellulosic fibers, and more preferably, the paper contains substantially entirely cellulosic fibers. All known conventional processes of making paper are capable of preparing paper treated according to the present invention. The invention will work on virtually any type of substrate and may be used on acid, alkaline, neutral and unsized sheet substrates. In this invention, the sheet substrate, most often paper, is formed prior to the application of the sizing composition that includes the soluble divalent metal salts of the invention.

The present invention is intended primarily, but not exclusively, for use with alkaline paper. The invention is particularly useful with precision paper handling grades of alkaline fine paper, including, without limitation, forms bond, cut sheet paper, copy paper, envelope paper, adding machine tape, and the like.

The paper is preferably paper in the form of a sheet or web having a basis weight in the range of about 30 g/m$^2$ to about 200 g/m$^2$, more preferably about 40 g/m$^2$ to about 120 g/m$^2$. The paper suitable for use in this invention includes paper having a basis weight typical of paper used in ink jet printing or conventional copy paper used in photocopy machines. Such printing and writing paper typically have a basis weight of about 60 to about 100 g/m$^2$. Other types of stock include, for example, newsprint with a basis weight of about 40 g/m$^2$ to about 60 g/m$^2$, kraft paper with a basis weight of about 50 g/m$^2$ to about 120 g/m$^2$, white-top liner board with a basis weight of about 120 g/m$^2$ to about 400 g/m$^2$, and coated grades thereof. Coated paper is treated with a wide range of fillers and binders over a base sheet that may be lightweight, such as about 40 g/m$^2$, or heavier, such as about 100 g/m$^2$.

Unlike prior art papers intended for use in ink jet printing, which are typically coated with materials that improve print quality of dye-based ink jet printing inks, the paper in the present invention does not require such prior art coatings. The paper can therefore be economically produced and is competitive with conventional uncoated copy paper, which is often used for multiple purposes.

The paper used in this invention may be made with or without conventional internal sizes being present. It is often preferred to use internal sizing agents, which may be present at addition levels of about 0.02 to about 4 kg/metric tonne of paper, more preferably about 0.2 to about 3 kg/metric tonne and most preferably about 0.5 to about 2 kg/metric tonne of paper. Conventional internal sizes may be used, for example ASA sizing agents and AKD sizing agents, as well as other reactive and non-reactive internal paper sizing agents. Such internal paper sizes may include and be identical to the surface sizing agents, and particularly the reactive surface sizing agents used in the present invention.

The metal salt of this invention can be used with substrates other than paper, e.g. substrates of polymeric plastic material typically formed by extrusion, casting or other known processes, useful in ink jet printing. For example, transparency films and other polymeric, preferably plastic, sheet materials may be treated according to this invention with the sizing composition containing the salt of this invention. Such transparency sheets may be used for making ink jet printable sheets for use with overhead projectors. Such polymeric sheet substrate materials may be polyester, polypropylene, polyethylene, acrylic or the like. The application of the metal salts to such substrates is similar to that described above except the substrate is a plastic sheet material and is coated by conventional coating methods, rather than with a paper machine size press.

The method of this invention can be used in the treatment of coated paper by incorporating the sizing agent containing the metal salt into a coating formulation. Coated paper is used in many applications, including dye-based ink jet printing. The addition of the salts from the salt-containing sizing agent composition of this invention enhances performance of such coated sheets for ink jet printing using pigment-based inks in addition to dye-based inks. The coating may be applied by conventional methods. A typical coating formulation may contain filler, binder, and rheology modifier. The coating formulation used in the preparation of coated papers should be selected so us to be compatible with the metal salts and other components of the sizing compositions of this invention. Such compositions may be added either in conjunction with, or in combination with, the application of the conventional coatings or may be applied after the conventional coating has been applied and dried or cured.

Paper for many end-use applications is generally converted into a more useful form through operations such as cutting, folding, perforating, printing, moving, stacking, and winding. The performance in such operations can be affected by paper additives. Conventional additives for enhancing ink jet printing, such as high levels of reactive size agents, can cause lower paper coefficients of friction and/or paper slipping on high speed equipment. Therefore, the amount of the sizing agent component of the compositions of the present invention should be controlled within the concentrations set forth above. Other additives, such as fillers, can dull cutting blades. As a result, the use of these types of fillers should likewise be controlled carefully.

Ink jet printing performance is improved by the presence of the metal salts of this invention, particularly for ink jet printing using pigmented ink jet inks. The present invention provides a high concentration of the ink jet-applied inks near the paper surface, and this increases the optical density of the printed image, a desirable result. The invention also limits the undesirable edge roughness of applied inks and this improves the clarity of the images, likewise a desirable characteristic. While not wishing to be bound by any particular theory or mechanism of action, the inventor believes that the metal salts of this invention contained in the paper interact with the pigmented inks to result in these improvements and the sizing component slows the penetration of the ink into the paper.

Performance evaluations of the compositions containing the divalent metal salts of this invention, along with other materials, for their effect in improving optical density and reducing show-through of pigmented ink applied to a base paper via an ink jet printer are noted below:

Calcium chloride ($CaCl_2$) provided excellent results, and magnesium chloride generally works as well or almost as well as calcium chloride on an equivalent weight basis. Calcium bromide also works well but not as well on an equivalent weight addition basis.

Calcium zirconate, ammonium zirconium carbonate, and zinc oxide generally do not provide the desired improvement, at normal usage levels.

Considering the results, it can be hypothesized (while not wishing to be bound or limited by any particular theory or mechanism of action) that the preferred $CaCl_2$ and $MgCl_2$ salts provide the best performance because of their solubility and their ability to strongly interact with the ink.

Generally, an increased concentration of metal salt within the indicated range leads to greater enhancement in ink jet print quality performance without increasing corrosion, or environmental problems and for reasons of economy. Not all metal salts give equal performance, as noted above. It was completely unexpected that metal salts, particularly calcium chloride and magnesium chloride, would give much better performance than other salts. It was also unexpected that the metal salts of this invention gave excellent performance, but other salts that were tried were ineffective. Having seen the results, the inventor believes (while not wishing to be bound or limited by any particular theory or mechanism of action) that the successful performance of various metal salts of this invention may be based on two factors: solubility and ionic strength. Magnesium and calcium salts are preferred because they provide the correct balance of these two factors.

EXAMPLES

The present invention will nowv be described in more detail with reference to the following specific, non-limiting Examples.

The procedures used in the Examples are laboratory scale procedures where efforts were made to mimic a paper machine size press application. This was accomplished by preparing paper beforehand in a separate operation, where the paper was not treated at a size press with starch or surface additive. The paper in the following Examples was prepared on a pilot paper machine at Western Michigan University. A representative fine paper furnish was used with the Western Michigan University paper machine, to make a typical alkaline fine paper. The paper (base sheets) was dried and stored.

In the Examples described below, the paper was passed through a laboratory puddle size press and the desired treatment applied. The treated paper was then immediately dried on a drum drier. The paper was conditioned for a minimum of 24 hours before ink jet testing. In all of the examples below the ink jet printing was conducted with the hewlett-Packard DeskJet 660C ink jet printer. The print settings were set on "best" and "plain paper" within the Hewlett-Packard software that was supplied with the printer. The print characteristics of the paper were measured at least 1 hour after printing. Optical density readings were made with a Cosar model 202 densitometer. Print characteristics were evaluated as described earlier using a test pattern with solid color areas, black text print, and black-on-yellow and yellow-on-black printed areas. A method of evaluation is described in Hewlett-Packard test criteria. The ratings listed on a scale of good, fair and poor are based on the Hewlett-Packard ratings of good, acceptable and unacceptable. See, *Hewlett Packard Paper Accepance Criteria for HP Desk Jet 500C, 550C and 560C Printers*, Hewlett-Packard Company, Jul. 1, 1994.

In all cases, starch was a significant component of the size press solution. Starch solutions were prepared by cooking the starch in water at about 95° C. for 30 to 60 minutes and then adjusting the pH to about 8. The components noted in the Examples were mixed into the starch. The mixtures were stirred and the pH was adjusted as noted in the Examples below. Within about 15 minutes of adding the materials to the starch mixtures, the mixtures were applied to the paper prepared as described above. The basis weight of the paper used was in all cases about that of normal copy paper, or 75 $g/m^2$.

The amounts of salts used were calculated on a dry salt basis based on the weight of dry paper, prior to the size press treatment (hereinafter "dry wt %").

In some cases, the sizing, or water hold-out, of the paper was measured by the Hercules Sizing Test (HST). The Hercules Sizing Test is a well-recognized test for measuring sizing performance and is described in J. P. Casey, Ed., *Pulp and Paper Chemistry and Chemical Technology*, Vol.3, pp. 1553–1554 (1981) and in TAPPI Standard T530. A higher HST number is considered to represent better sizing ability (less water penetration).

Example 1

Effect of Salt Level

Example 1 demonstrates the effect on ink jet print quality of the amount of surface-applied salt on the surface treated dry paper. A base sheet was made on the pilot paper machine at Western Michigan University with a 70:30 bleached hardwood:softwood pulp mixture beat to 425 Canadaian Standard Freeness (CSF) and containing internally 12% ALBACAR® PO precipitated calcium carbonate, (from Specialty Minerals Inc., Bethlehem, Pa.), 0.15% HERCON® 76 sizing agent (from Hercules Incorporated, Wilmington, Del.), and no alum. This base sheet was surface treated with starch alone and with mixtures of starch with several salts, as follows: calcium chloride, magnesium chloride, calcium bromide and potassium chloride. The salts were applied at the amounts as shown in Table 1 below.

An 8 dry wt % solution of GPC® D-150 oxidized corn starch (from Grain Processing Company, Muscatine, Iowa) was used. A sample treated with just the 8% GPC® D-150 corn starch solution is included for comparison. Premixes of the various salts noted above and FLEXBOND® 325 cationic copolymer of vinyl acetate and butyl acrylate (from Air Products and Chemicals Inc.), having a glass transition temperature of 15° C., a mean particle size of 0.3 microns, pH of 4.0–6.0, viscosity of 700–1200 cps, and 55% solids emulsion, were added to the starch solution. In all cases except the starch alone sample, 0.15 dry wt % FLEXBOND® solids was added to the paper by adding 0.72 g of the 55% solids FLEXBOND® emulsion per 100 g of starch solution. The salts were added to the starch solution at a level to give the addition levels in the final paper that are shown below in Table 1.

These starch solutions were adjusted to approximately pH 7.5 and then applied at the size press to surface treat the paper. The ink jet print quality of the resulting paper was evaluated, and the results are shown in Table 1.

TABLE 1

| SALT | DRY WT % OF SALT | BLACK OD |
|---|---|---|
| Calcium Chloride | 0.15 | 1.34 |
| Magnesium Chloride | 0.13 | 1.30 |
| Magnesium Chloride | 0.15 | 1.35 |
| Calcium Bromide | 0.15 | 1.24 |
| Calcium Bromide | 0.27 | 1.38 |
| Potassium Chloride | 0.15 | 1.16 |
| Potassium Chloride | 0.20 | 1.15 |
| Starch | 0 | 1.10 |

The black optical density (OD) results from the ink jet printing show that $CaCl_2$ and $MgCl_2$ are more efficient at increasing optical density than KCl, and on a weight basis, they are more efficient than $CaBr_2$. Bromine ions are much heavier than chlorine ions so, on an equal weight basis of salt, there is less calcium added when $CaBr_2$ is used versus $CaCl_2$. $MgCl_2$ and $CaCl_2$ give about equal results on a weight basis. On an equal molar basis, 0.13 $MgCl_2$ v.0.15 $CaCl_2$, the calcium salt gave a greater improvement.

Example 2

Calcium Chloride Combined with Non-Reactive Sizing Agent in the Starch Size Press Solution the Addition of Calcium Chloride Alone in the Starch Solution Example 2 was carried out to evaluate the effect on the resulting paper's ink jet print quality of a surface-applied metal salt used in combination with a non-reactive surface sizing agent, both being applied to paper at the starch size press. A base sheet was made on the pilot paper machine at Western Michigan University with a 70:30 bleached hardwood:softwood pulp mixture beat to 390 CSF and containing internally 20% HYDROCARB™ 65 calcium carbonate filler (from OMYA, Inc., Florence, Vt.), 0.5% HI-CAT® 142 cationic starch (from Roquette Freres, Lestrem, France), 0.12% AQUAPEL® 320 sizing agent(from Hercules Incorporated), and no alum. This base sheet was surface treated at the size press with starch alone, with a mixture of starch with calcium chloride, and with a mixture of starch, calcium chloride, and BASOPLAST® 335D polymeric surface size, a non-reactive sizing agent.

An 8 dry wt % solution of GPC® D-150 corn starch was used at the size press, as in previous Examples. The metal salt and polymeric sizing agent were added to the starch solution at a level to get a desired final level in the paper based on the amount of starch solution picked up by the paper during the size press treatment. The pH of the final size mixtures were not adjusted after the addition of the sizing agents. The pick-up of the starch solution was 34.7% based on the wet weight of the starch solution to the initial weight of the paper.

The ink jet print quality and the sizing property of the resulting paper were evaluated, and these results are shown below in Table 2, where the standard HST ink, with a pH of 2, was used.

TABLE 2

| 335D LEVEL* | Mixture pH | $CaCl_2$ LEVEL* | pH 2 HST (sec) | BLACK OD |
|---|---|---|---|---|
| 0 | 7.7 | 0 | 91 | 0.98 |
| 0 | 6.9 | 0.25 | 52 | 1.39 |
| 0.1 | 4.8 | 0 | 127 | 1.08 |
| 0.1 | 4.5 | 0.25 | 141 | 1.55 |

*dry wt %

The results in Table 2 show that the presence of calcium chloride on the $CaCl_2$-treated paper provided a significant improvement in black optical density, both when the $CaCl_2$ was used alone and when it was applied in combination the BASOPLAST® 335D non-reactive polymeric surface size.

The results of HST sizing performance in the Table confirm that the improved black OD performance is not an artifact of an increase in water hold-out as measured by HST. This is evident since the HST sizing performance was lower (52 sec.) for the polymeric surface size-free paper containing the $CaCl_2$ salt than for the same paper without polymeric size and $CaCl_2$ (91 sec.). The HST sizing performance results for the two paper evaluations in which a polymeric surface size was present are similar (127 sec. without $CaCl_2$ and 141 sec. with $CaCl_2$), and this difference in HST size performance is not considered significant.

In addition, the combination of non-reactive sizing agent and $CaCl_2$ provides an enhanced or synergistic increase in black optical density for the surface-treated paper, over and above the expected additive increase of the two used separately. The presence of the metal salt therefore provides an unexpected and surprising improvement in ink jet print quality for surfaced sized paper containing a non-reactive sizing agent.

Example 3

Premixture of Calcium Chloride and Reactive Sizing Agent Introduced to the Size Press Solution Example 3 was carried out to evaluate the effect on the resulting paper's ink jet print quality of a surface-applied metal salt used in combination with a reactive surface sizing agent, both being combined in a premixture that was subsequently applied to paper at the starch size press. The reactive sizing agent used in this Example 3 was an alkenyl ketene dimer paper sizing agent.

A base sheet was made on the pilot paper machine at Western Michigan University with a 70:30 bleached hardwood:softwood pulp mixture beat to 390 CSF and containing internally 15% ALBACAR® HO precipitated calcium carbonate filler, 0.26% STA-LOK® 400 cationic starch (from A.E. Staley Company, Decatur, Ill.), 0.08% alkenyl succinic anhydride, and 0.25% alum. This base sheet was surface treated using the laboratory puddle size press with: (A) starch alone; (B) starch solution containing a reactive surface size emulsion containing alkenyl ketene dimer (no metal salt being present); and (C) starch solution containing a premixture of the ketene dimer size emulsion and calcium chloride. To prepare the premixture, a 50:50 solution of calcium chloride dihydrate to water was added to the ketene dimer emulsion, and the premixture contained 9.0 wt % solids from the dimer cmulsion and 33.8 wt % calcium chloride, based on the weight of the premixture.

An 8 dry wt % solution of GPC® D-150 corn starch was used at the size press, as described in previous Examples. The materials were added to the starch at a level to provide a desired final level of ketene dimer surface size and/or calcium chloride in the paper (as shown below in Table 3) based on the amount of starch pick-up.

The ink jet print quality and the sizing property of the resulting paper were evaluated, and these results are shown below in Table 6, where the standard HST ink, with a pH of 2, was used.

TABLE 3

| SAMPLE | SOLIDS LEVEL (%) FROM KETENE DIMER* | $CaCl_2$ LEVEL* | pH 2 HST (sec) | BLACK OD |
|---|---|---|---|---|
| A | 0 | 0 | 2 | 1.10 |
| B | 0.025 | 0 | 35 | 1.45 |
| C | 0.025 | 0.094 | 42 | 1.59 |

*dry wt %

The results shown in Table 3 demonstrate that the premixture containing a combination of $CaCl_2$ with a reactive size, when applied as a surface treatment to paper at the size press, gave an excellent black OD for the resulting paper, higher than the black OD obtained either with no reactive surface size present or with the use of the reactive surface size alone, both without the presence of a metal salt.

Example 4

Calcium Chloride Combined with a Multimer Based Reactive Sizing Agent

Example 4 was carried out to demonstrate that the combination of $CaCl_2$ as the metal salt with another reactive size, when both are applied as a surface treatment to paper at the size press, provides excellent ink jet print quality for the resulting paper. The reactive sizing agent used in this Example 4 was a ketene multimer paper sizing agent, described in International Patent Application Publication No. WO 97/30218, published Aug. 21, 1997, different from the ketene dimer sizing agent used in the previous example.

The same procedure as described for Example 3 was followed. Starch solution alone (A) was tested; (B) starch solution containing the ketene multimer emulsion was added to the paper as a surface treatment, without a metal salt being present; and (C) starch solution and a premixture of calcium chloride with the ketene multimer emulsion; all being applied to the paper at the size press in the same manner as in Example 3. The ink jet print quality and the sizing property of the resulting paper were evaluated, and these results are shown below in Table 4.

TABLE 4

| SAMPLE | SOLIDS LEVEL (%) FROM KETENE MULTIMER* | $CaCl_2$ LEVEL* | BLACK OD |
|---|---|---|---|
| A | 0 | 0 | 1.10 |
| B | 0.03 | 0 | 1.41 |
| C | 0.03 | 0.15 | 1.54 |

*dry wt %

The results shown in Table 4 demonstrate that the premixture containing a combination of $CaCl_2$ with a reactive size, when applied as a surface treatment to paper at the size press, gave an excellent black OD for the resulting paper, higher than the black OD obtained either with no reactive surface size present or with the use of the reactive surface size alone, both without the presence of a metal salt.

Examples 1–4 demonstrate that the present invention provides improved ink jet print quality, as measured by enhanced black ink optical density, with a metal salt used in combination either with a non-reactive surface sizing agent or with a reactive surface sizing agent applied to the paper being surface treated with the metal salt, as compared with the ink jet print quality obtained with surface sizing agent alone.

Example 5

Calcium Chloride Combined with a Non-reactive and a Reactive Sizing Agent

A base sheet made at Western Michigan University with a 75:25 bleached hardwood:softwood pulp mixture beat to 425 CSF and containing internally 10% ALBACAR® HO precipitated calcium carbonate, 0.05% alkenyl succinic anhydride sizing agent, 0.75% STA-LOK® 400 cationic starch and 0.25% alum, was treated with (A) starch solution alone (8 dry wt % starch GPC® D150 solution); (B) starch solution with PRINTRITE® 594 polymer latex (from B.F. Goodrich Company, Akron, Ohio); (C) starch solution and PRINTRITE® 594 polymer latex premixed with PRECIS® 2000 reactive sizing dispersion; and (D) starch solution and PRINTRITE® polymer latex premixed with both PRECIS® 2000 reactive sizing dispersion calcium chloride. The ratio in the first premixture was 1:8 PRECIS® 2000 solids to polymer solids. The ratio in the second premixture was 9:1:8 calcium chloride: PRECIS® 2000 solids: polymer solids. The materials were added to an 8 dry wt % starch solution and the final pH adjusted to approximately pH 8. The solutions were used in the size press to treat the paper. The levels of materials added to the starch were adjusted based on the amount of starch solution picked up by the paper. The results are listed in Table 5, where the standard HST ink, with a pH of 2, was used.

TABLE 5

| SAMPLE | SOLIDS LEVEL (%) FROM PRECIS ® 2000* | $CaCl_2$ LEVEL* | POLYMER LEVEL | pH2 HST (sec) | BLACK OD |
|---|---|---|---|---|---|
| A | 0 | 0 | 0 | 2 | 1.29 |
| B | 0 | 0 | 0.150 | 48 | 1.36 |

TABLE 5-continued

| SAMPLE | SOLIDS LEVEL (%) FROM PRECIS ® 2000* | $CaCl_2$ LEVEL* | POLYMER LEVEL | pH2 HST (sec) | BLACK OD |
|---|---|---|---|---|---|
| C | 0.017 | 0 | 0.133 | 83 | 1.54 |
| D | 0.017 | 0.15 | 0.133 | 74 | 1.70 |

*dry wt %

Adding $CaCl_2$ to a polymer emulsion that provides sizing enhanced the ink jet printing. The further addition of a reactive sizing agent gave a further boost in performance.

Example 6

Calcium Chloride Combined with a Non-reactive and a Reactive Sizing Agent

A base sheet made at Western Michigan University with a 70:30 bleached hardwood:softwood pulp mixture beat to 390 CSF and containing internally 15% ALBACAR® HO precipitated calcium carbonate, 0.11% alkenyl succinic anhydride sizing agent, 0.50% STA-LOK® 400 cationic starch and 0.25% alum, was treated with (A) starch alone; and mixtures of starch with (B) a premixture of an emulsion of a sizing agent formed from PENTAPRINT® H sizing agent and calcium chloride, and (C) PENTAPRINT® H sizing agent premixed with both an alkyl ketene dimer dispersion (HERCON® 70) and calcium chloride. The ratio in the first premixture was 2:1 PENTAPRINT® H solids to calcium chloride. The ratio in the second premixture was 2:1:0.1 solids from PENTAPRINT® H:calcium chloride: solids from HERCON® 70. The materials were added to an 8 dry wt % starch solution and the final pH adjusted to approximately pH 8. The solutions were used in the size press to treat the paper. The levels of materials added to the starch were adjusted based on the amount of starch solution picked up by the paper. A sample was treated with an 8 dry wt % GPC® D150 oxidized starch solution for comparison. The results are listed in Table 6.

TABLE 6

| SAMPLE | SOLIDS LEVEL (%) FROM HERCON ® 70* | $CaCl_2$ LEVEL* | PENTAPRINT LEVEL | BLACK OD |
|---|---|---|---|---|
| A | 0 | 0 | 0 | 1.14 |
| B | 0 | 0.15 | 0.30 | 1.53 |
| C | 0.015 | 0.15 | 0.30 | 1.62 |

*dry wt %

A premixture of $CaCl_2$ to a resin dispersion gave a surface additive that provided enhanced the ink jet printing. The further addition of a reactive sizing agent to the premixture gave a further boost in performance.

Example 7

Premixture of Calcium Chloride and Reactive Sizing Agent Introduced to the Size Press Solution Example 7 was carried out to evaluate the effect on the resulting paper's ink jet print quality of a surface-applied metal salt used in combination with a reactive surface sizing agent, both being combined in a premixture that was subsequently applied to paper at the starch size press. The reactive sizing agent used in this Example 7 was an alkenyl ketene dimer paper sizing agent.

A base sheet was made on the pilot paper machine at Western Michigan University with a 75:25 bleached hardwood:softwood pulp mixture beat to 425 CSF and containing internally 10% ALBACAR® HO precipitated calcium carbonate filler, 0.6% STA-LOK® 400 cationic starch, 0.05% alkenyl succinic anhydride, and 0.25% alum. This base sheet was surface treated using the laboratory puddle size press with: (A) starch alone; (B) starch solution containing a reactive surface size emulsion containing alkenyl ketene dimer (PRECIS® 2000) and calcium chloride. To prepare the premixture, a 50:50 solution of calcium chloride dihydrate to water was added to the ketene dimer emulsion, and the premixture contained 13.56 wt % solids from the dimer emulsion and 20.34 wt % calcium chloride, based on the weight of the premixture.

An 8 dry wt % solution of GPC® D-150 corn starch was used at the size press, as described in previous Examples. The materials were added to the starch at a level to provide a desired final level of ketene dimer surface size and/or calcium chloride in the paper (as shown below in Table 7a) based on the amount of starch pick-up.

The ink jet print quality and the sizing property of the resulting paper were evaluated, and these results are shown below in Table 7a, where the standard HST ink, with a pH of 2, was used, and in Tables 7b and 7c.

TABLE 7a

| SAMPLE | SOLIDS LEVEL (%) FROM KETENE DIMER* | $CaCl_2$ LEVEL* | pH 2 HST (sec) |
|---|---|---|---|
| A | 0 | 0 | 2 |
| B | 0.12 | 0.18 | 126 |

*dry wt %

TABLE 7b

Hewlett Packard DeskJet ® 660C Black Print Quality:

| SAMPLE | BLACK OD | BLACK LINE GROWTH | BLACK EDGE ROUGHNESS |
|---|---|---|---|
| A | 1.25 | Fair | Fair |
| B | 1.60 | Good | Good |

TABLE 7c

Hewlett Packard DeskJet ® 660C Black Against Yellow Print Quality:

| SAMPLE | CYAN OD | BLACK/YELLOW LINE GROWTH | BLACK/YELLOW EDGE ROUGHNESS |
|---|---|---|---|
| A | 0.77 | Fair to good | Fair |
| B | 0.77 | Fair to good | Good |

Among the unexpected advantages of the invention are the compatibility of the salts with surface additives; the compatibility of premixtures of the salts with surface additives; the compatibility of the salts with the size press solution; the absence of problems applying such compositions to paper; the enhanced performance of the resulting paper for the application of ink jet printing with pigmented inks; and the additive benefits of salts with reactive sizing agents, salts with nonreactive sizing agents and mixtures of salts, reactive sizing agents and nonreactive sizing agents. The present invention particularly enhances at least the following print quality characteristics: optical density, show through, line growth, bleed, edge roughness, wicking and mottle.

The present invention may be embodied in other specific forms without departing from the spirit or essential attributes thereof and, accordingly, reference should be made to the appended claims, rather than to the foregoing specification, as indicating the scope of the invention.

What is claimed is:

1. A dried substrate surface treated for ink jet printing, the substrate being selected from the group consisting of paper and polymeric plastic material, wherein the substrate's surface is treated with a composition comprising a salt of a divalent metal, the salt being soluble in an aqueous sizing medium at about pH 7 to about pH 9, the aqueous sizing medium further comprising a carrier agent and a sizing agent.

2. The substrate of claim 1 wherein the salt is selected from the group consisting of calcium chloride, magnesium chloride, calcium bromide, magnesium bromide, calcium nitrate, magnesium nitrate, calcium acetate and magnesium acetate.

3. The substrate of claim 2 wherein the salt is calcium chloride.

4. The substrate of claim 2 wherein the salt is magnesium chloride.

5. The substrate of claim 1 wherein the carrier agent is starch.

6. The substrate of claim 1 wherein the carrier agent is a binding agent.

7. The substrate of claim 6 wherein the binding agent is selected from the group consisting of polyvinyl alcohol, polyvinylpyrrolidone and polyethyleneimine.

8. The substrate of claim 1 wherein the sizing agent is a reactive sizing agent.

9. The substrate of claim 8 wherein the reactive sizing agent is selected from the group consisting of an alkyl ketene dimer, an alkenyl ketene dimer, a 2-oxetanone dimer, a 2-oxetanone multimer, and an alkenyl succinic anhydride sizing agent.

10. The substrate of claim 9 wherein the reactive sizing agent is an alkenyl ketene dimer.

11. The substrate of claim 9 wherein the reactive sizing agent is a 2-oxetanone multimer.

12. The substrate of claim 8, further comprising a nonreactive sizing agent.

13. The substrate of claim 12 wherein the nonreactive sizing agent is a polymer emulsion selected from the group consisting of a cationic polymer emulsion, an amphoteric polymer emulsion and mixtures thereof.

14. The substrate of claim 13 wherein the polymer of the polymer emulsion is made using at least one monomer selected from the group consisting of styrene, α-methylstyrene, acrylate having an ester substituent with 1 to 13 carbon atoms, methacrylate having an ester substituent with 1 to 13 carbon atoms, acrylonitrile, methacrylonitrile, vinyl acetate, ethylene and butadiene; and optionally comprising acrylic acid, methacrylic acid, maleic anhydride, esters of maleic anhydride or mixtures thereof, with an acid number less than about 80.

15. The substrate of claim 14 wherein the polymer is made using at least one monomer selected from the group consisting of styrene, acrylate having an ester substituent with 1 to 13 carbon atoms, methacrylate having an ester substituent with 1 to 13 carbon atoms, acrylonitrile and methacrylonitrile.

16. The substrate of claim 13 wherein the polymer emulsion is stabilized by a stabilizer comprising predominantly degraded starch.

17. The substrate of claim 13 wherein the polymer emulsion has a glass transition temperature of about −15° C. to about 50° C.

18. The substrate of claim 1 wherein the sizing agent is a nonreactive sizing agent.

19. The substrate of claim 18 wherein the nonreactive sizing agent is a polymer emulsion selected from the group consisting of a cationic polymer emulsion, an amphoteric polymer emulsion and mixtures thereof.

20. The substrate of claim 19 wherein the polymer of the polymer emulsion is made using at least one monomer selected from the group consisting of styrene, α-methylstyrene, acrylate having an ester substituent with 1 to 13 carbon atoms, methacrylate having an ester substituent with 1 to 13 carbon atoms, acrylonitrile, methacrylonitrile, vinyl acetate, ethylene and butadiene; and optionally comprising acrylic acid, methacrylic acid, maleic anhydride, esters of maleic anhydride or mixtures thereof, with an acid number less than about 80.

21. The substrate of claim 20 wherein the polymer is made using at least one monomer selected from the group consisting of styrene, acrylate having an ester substituent with 1 to 13 carbon atoms, methacrylate having an ester substituent with 1 to 13 carbon atoms, acrylonitrile and methacrylonitrile.

22. The substrate of claim 19 wherein the polymer emulsion is stabilized by a stabilizer comprising predominantly degraded starch.

23. The substrate of claim 19 wherein the polymer emulsion has a glass transition temperature of about −15° C. to about 50° C.

24. The substrate of claim 18 wherein the nonreactive sizing agent is a dispersed rosin sizing agent.

25. The substrate of claim 1 wherein the salt of the divalent metal is solubilized in the aqueous sizing medium at about pH 7 to about pH 9.

26. The substrate of claim 1 wherein the substrate is paper.

27. The paper of claim 26 wherein the paper comprises fibers that are predominantly cellulosic fibers.

28. The paper of claim 27 wherein the paper comprises fibers that are substantially entirely cellulosic fibers.

29. The substrate of claim 1 wherein the substrate is a polymeric plastic material.

30. The substrate of claim 1, wherein tle substrate is surface treated with the composition of claim 1 for subsequent ink jet printing wit pigmented ink.

31. The substrate of claim 1 wherein the sizing agent is a nonreactive sizing agent, the nonreactive sizing agent being a polymer emulsion selected from the group consisting of a cationic polymer emulsion, an amphoteric polymer emulsion and mixtures thereof, wherein the polymer of the polymer emulsion is made using at least one monomer selected from the group consisting of styrene, acrylate having an ester substituent with 1 to 13 carbon atoms, methacrylate having an ester substituent with 1 to 13 carbon atoms, acrylonitrile and methacrylonitrile, wherein the polymer emulsion is stabilized by a stabilizer comprising predominantly degraded starch, and wherein the polymer emulsion has a glass transition temperature of about −15° C. to about 50° C.

32. The substrate of claim 1 wherein the salt is present in an amount of about 0.01% to about 0.4% based on the weight of the dried treated substrate.

33. The substrate of claim 1 wherein the salt is present in an amount of about 0.02% to about 0.3% based on the weight of the dried treated substrate.

34. The substrate of claim 1 wherein the salt is present in an amount of about 0.05% to about 0.2% based on the weight of the dried treated substrate.

35. The substrate of claim 1 wherein the substrate is a sheet substrate and the salt is present in the treated sheet substrate in an amount of about 0.01 $g/m^2$ to about 1 $g/m^2$.

36. The substrate of claim 35 wherein the salt is present in the treated sheet substrate in an amount of about 0.02 $g/m^2$ to about 0.3 $g/m^2$.

37. The substrate of claim 36 wherein the salt is present in the treated sheet substrate in an amount of about 0.03 $g/m^2$ to about 0.2 $g/m^2$.

38. The substrate of claim 1 wherein the substrate is printing and writing paper having a basis weight of about 60 $g/m^2$ to about 100 $g/m^2$.

39. The substrate of claim 1 wherein the substrate is newsprint having a basis weight of about 40 $g/m^2$ to about 60 $g/m^2$.

40. The substrate of claim 1 wherein the substrate is kraft paper having a basis weight of about 50 $g/m^2$ to about 120 $g/m^2$.

41. The substrate of claim 1 wherein the substrate is white-top liner board having a basis weight of about 120 $g/m^2$ to about 400 $g/m^2$.

42. The substrate of claim 1 wherein the divalent metal salt is solubilized in the aqueous sizing medium at about pH 7 to about pH 9.

43. The substrate of claim 1, wherein the substrate is a printing substrate, the printing substrate carrying indicia formed from pigmented ink on the dried treated substrate, such that the indicia has at least one improved ink jet printing characteristic compared to a printing substrate treated using the composition of claim 1 but without the salt.

44. The printing substrate of claim 43 wherein the substrate is paper.

45. The printing substrate of claim 44 wherein the paper comprises fibers that are predominantly cellulosic fibers.

46. The printing substrate of claim 45 wherein the paper comprises fibers that are substantially entirely cellulosic fibers.

47. The printing substrate of claim 43 wherein the substrate is polymeric plastic material.

48. The printing substrate of claim 1 having at least one improved ink jet printing characteristic selected from the group consisting of optical density, show through, line growth, bleed, edge roughness, wicking and mottle.

49. The printing substrate of claim 48 wherein the improved ink jet printing characteristic is optical density.

50. The substrate of claim 1, wherein the substrate is paper, the substrate further comprising pigmented ink applied to the surface of the dried treated substrate by ink jet printing, the printed substrate being an ink jet printed paper.

51. The ink jet printed paper of claim 50 wherein the paper comprises fibers that are predominantly cellulosic fibers.

52. The ink jet printed paper of 51 wherein the paper comprises fibers that are substantially entirely cellulosic fibers.

53. The ink jet printed paper of claim 50, wherein the indicia will have at least one improved ink jet printing characteristic compared to paper made as in claim 50 but without the salt, wherein the improved ink jet printing characteristic is at least one selected from the group consisting of optical density, show through, line growth, bleed, edge roughness, wicking and mottle.

54. The ink jet printed paper according to claim 53 wherein the improved ink jet printing characteristic is optical density.

* * * * *